US006562220B2

(12) United States Patent
Gillman et al.

(10) Patent No.: US 6,562,220 B2
(45) **Date of Patent: *May 13, 2003**

(54) METAL ALLOY SULFATE ELECTROPLATING BATHS

(75) Inventors: Hyman D. Gillman, Spring City, PA (US); Brenda Fernandes, Cranston, RI (US); Kazimierz Wikiel, Wakefield, RI (US)

(73) Assignee: Technic, Inc., Cranston, RI (US)

( * ) Notice: Subject to any disclaimer, the term of this patent is extended or adjusted under 35 U.S.C. 154(b) by 74 days.

This patent is subject to a terminal disclaimer.

(21) Appl. No.: 09/862,166

(22) Filed: May 21, 2001

(65) Prior Publication Data

US 2002/0014414 A1 Feb. 7, 2002

Related U.S. Application Data

(63) Continuation-in-part of application No. 09/272,800, filed on Mar. 19, 1999, now Pat. No. 6,251,253.

(51) Int. Cl.[7] ..... C25D 3/02

(52) U.S. Cl. ..... 205/239; 205/240; 205/241; 205/244; 205/245; 205/246; 205/254; 205/255; 205/274; 205/281; 205/296; 205/302; 205/311; 205/242; 106/1.21; 106/1.25

(58) Field of Search ..... 205/239, 240, 205/241, 246, 254, 255, 274, 281, 296, 302, 311, 242; 106/1.21, 1.25

(56) References Cited

U.S. PATENT DOCUMENTS

| | | | | |
|---|---|---|---|---|
| 2,910,413 A | * | 10/1959 | Strauss et al. | 205/281 |
| 3,616,306 A | | 10/1971 | Conoby et al. | 204/54 R |
| 4,331,518 A | | 5/1982 | Wilson | 204/43 |
| 4,347,107 A | | 8/1982 | Teichmann et al. | 204/44 |
| 4,459,185 A | | 7/1984 | Obata et al. | 204/43 |
| 4,717,460 A | | 1/1988 | Nobel et al. | 204/444 |
| 4,828,657 A | | 5/1989 | Fukuoka et al. | 204/44.4 |
| 4,871,429 A | | 10/1989 | Nobel et al. | 204/44.4 |
| 5,051,154 A | | 9/1991 | Bernards et al. | 204/24 |
| 5,066,367 A | | 11/1991 | Nobel et al. | 204/44.4 |
| 5,174,886 A | | 12/1992 | King et al. | 205/125 |
| 5,492,615 A | | 2/1996 | Houman | 205/238 |
| 5,538,617 A | | 7/1996 | Steinbicker et al. | 205/302 |
| 5,562,814 A | | 10/1996 | Kirby | 205/238 |
| 5,759,381 A | * | 6/1998 | Sakurai et al. | 205/253 |
| 6,251,253 B1 | * | 6/2001 | Gillman et al. | 205/239 |

FOREIGN PATENT DOCUMENTS

| | | |
|---|---|---|
| EP | 0 455 166 A1 | 6/1991 |
| EP | 0 787 834 A1 | 1/1997 |

OTHER PUBLICATIONS

Meibuhr et al., *Noble Metal Resistors in Miicrocircuits*, "The Mechanism of the Inhibition of Stannous–Ion Oxidation by Phenolsulfonic Acid", vol. 2, No. 9–10, pp. 267–273.

Lasia et al., "Double–layer effects in the kinetics of the $CD^{2+}$/CD (Hg) system in dimethylsulfoxide", *J. Electroanal. Chem.*, 266 (1989) pp. 68–81.

Fawcett et al., "Double layer effects in the kinetics of electroeduction of zinc (II) at mercury in dimethylformamide and dimethylsulfoxide", *J. Electroanal. Chem.*, 279 (1990), pp. 243–256.

Balch et al.,"The solvent effect on the electrochemical behavior of $C_{60}$ films in the presence of alkali–metal cations", *Journal of Electroanalytical Chemistry* 427 (1997), pp. 137–146.

Lasia et al., "Mechanism of zinc(II) reduction in DMSO on mercury", *J. Electroanal. Chem.*, 288 (1990), pp. 153–165.

* cited by examiner

*Primary Examiner*—Kishor Mayekar
(74) *Attorney, Agent, or Firm*—Ernest V. Linek; Banner & Witcoff, Ltd.

(57) ABSTRACT

The use of alkali metal, alkaline earth metal, ammonium and substituted ammonium salts of alkyl and alkanol sulfonic acids as additives in pure metal and metal alloy sulfate electroplating baths has a number of unexpected benefits including wider useful current density range, improved appearance and in the case of tin improved oxidative stability. The metals and alloys include but are not limited to tin, nickel, copper, chromium, cadmium, iron, rhodium, ruthenium, iron/zinc and tin/zinc.

31 Claims, No Drawings

METAL ALLOY SULFATE ELECTROPLATING BATHS

The present invention is a continuation-in-part of a commonly owned and copending application. U.S. Ser. No. 09/272,800, filed on Mar. 19, 1999, now U.S. Pat. No. 6,251,253, the disclosure of which is hereby incorporated by reference.

BACKGROUND OF THE INVENTION

Electroplating solutions are usually aqueous. Every plating solution contains ingredients to perform at least the first, and usually several, of the following functions: (1) provide a source of ions of the metal(s) to be deposited; (2) form complexes with ions of the depositing metal; (3) provide conductivity; (4) stabilize the solution against hydrolysis or other forms of decomposition; (5) buffer the pH of the solution; (6) regulate the physical form of the deposit; (7) aid in anode corrosion; and (8) modify other properties peculiar to the solution involved.

The present invention improves the plating performance of the solution, particularly by increasing the useful current density over previously accepted norms. The current density is the average current in amperes divided by the area through which that current passes; the area is usually nominal area, since the true area for any but extremely smooth electrodes is seldom known. Units used in this regard are amperes per square meter ($A/m^2$).

It is also in the best interest of efficiency to run these plating baths at as high a current density as possible. The higher the current density the faster the coating plates on the surface. The current is carried by the ions in these baths and each type of ion has its own specific conductance. In plating bath, however, ionic conductance is only one variable that must be considered in choosing an electrolyte. The final criterion is the quality of the coating at the desired current density.

SULFATE BATHS

A variety of metals and metal alloys are commercially plated from solutions with sulfate as the primary anion. See for example U.S. Pat. Nos. 4,347,107; 4,331,518 and 3,616,306. Certain sulfate electroplating baths have limitations that can sometimes be alleviated with the addition of additives including other anions. For example the steel industry has been tin plating steel for many years from sulfuric acid/tin sulfate baths where phenol sulfonic acid is used as a special electrolyte additive which improves both the oxidative stability of the tin as well as increasing its current density range. This is known as the ferrostan process but because of environmental problems with phenol derivatives the steel industry is looking to replace this bath with one which is less harmful to the environment.

Similarly nickel sulfate is used for nickel plating but nickel chloride must also be present to provide enough conductivity and improve anode dissolution. This bath is known as the Watts bath but although economical, suffers from a number of disadvantages including a nickel plate that is highly stressed.

It is therefore worthwhile to identify other additives that can improve the performance of metal sulfate electroplating baths. There are many examples in the prior art where surfactants and other organic additives are used to provide a more desirable finish. In the case of tin the prior art also describes additives which can improve the oxidative stability of the tin and therefore provide a bath with less sludge formation. It is less common to find examples of additives which improve the plating range especially at the high current density end. Increasing the current density is a very desirable feature but it has been difficult to identify additives which can do this without creating other problems in the bath.

Many plating baths are also very sensitive to the presence of impurities and often as impurities build up in the bath they affect the quality of the deposit. Therefore either these impurities must be removed or the baths must be replaced. For example in tin plating steel, iron builds up in the bath and eventually affects the quality of the deposit and must be removed. It is very desirable to find additives that will make the bath less sensitive to these impurities.

SUMMARY OF THE INVENTION

The present invention relates to the use of alkali metal, alkaline earth metal, ammonium and substituted ammonium salts of alkyl and alkanol sulfonic acid which have been found to improve the performance of sulfate electroplating baths. When used in these electroplating baths these salt additives were found to generally increase the plating range so that these baths can be used at much higher current densities. Thus these baths can be run at greater speeds than those without these additives. Further improvements are seen in the quality of the deposits. In the case of stannous sulfate plating solutions, some improvements in the oxidative stability of the tin was also observed.

Thus, the present invention is directed to a method of improving the plating performance of an aqueous sulfate based electroplating bath comprising the step of adding an effective performance enhancing amount of a salt of an alkyl and/or alkanol sulfonic acid to said bath.

The salts used to improve the bath plating performance characteristics are particularly selected from the group consisting of alkali metal, alkaline earth metal, ammonium and substituted ammonium salts. Especially preferred are salts of 2-hydroxy ethyl sulfonic acid, especially the sodium salt (sodium isethionate).

The baths that can be improved by the present invention include tin and tin alloys, nickel and nickel alloys, copper and copper alloys, chromium and chromium alloys, cadmium and cadmium alloys, iron and iron alloys, rhodium and rhodium alloys, ruthenium and ruthenium alloys, and especially the iron/zinc and tin/zinc alloy plating baths.

Preferably, tin and tin alloy baths are improved by this invention. Examples include tin-antimony, tin-cadmium, tin-copper, tin-lead, tin-nickel, tin-niobium, tin-titanium, tin-zirconium, and tin-antimony-copper, tin-silver, tin-bismuth, tin-copper-silver, tin-copper-bismuth alloy baths. Alloy compositions comprising these metals are well known to those having ordinary skill in this art, and are the subjects of numerous patents.

DETAILED DESCRIPTION OF THE PREFERRED EMBODIMENTS

The use of alkali metal, alkaline earth metal, ammonium and substituted ammonium salts of alkyl and alkanol sulfonic acids as additives in pure metal and metal alloy sulfate electroplating baths has a number of unexpected benefits including wider useful current density range, improved appearance and in the case of tin improved oxidative stability.

Thus these baths can be run at greater speeds than those without these additives. Further improvements are seen in the quality of the deposits and greater tolerance to impurities such as iron. In the case of stannous sulfate plating solutions some improvements in the oxidative stability of the tin was also observed.

Unlike phenol sulfonic acid these salts are not harmful to the environment. They are completely biodegradable and the products of the biodegradation are common ions and molecules found in the environment. In addition they have a number of other advantages including high solubility, low corrosivity to equipment, good stability at high temperatures, and compatibility with many other metal salts.

These baths also contain the corresponding metal salt or metal salts if any alloy plate is required, and various additives to control the quality and appearance of the plated surface and the stability of the bath solution. Typical additives include a surfactant such as an ethoxylated fatty alcohol, a brightening agent if required and an antioxidant such as hydroquinone or catechol, if tin is one of the metals being plated.

The tin in these baths is in the stannous or reduced form. If oxidation occurs the tin will be converted to the stannic or oxidized form which then commonly precipitates to form a sludge. The process adds to the inefficiency of these baths and also creates a requirement for constant filtering. Several patents, for example U.S. Pat. Nos. 4,717,460, 5,538,617 and 5,562,814, describe additives and/or processes that can decrease the amount of tin being oxidized.

The present invention will be further illustrated with reference to the following example which will aid in the understanding of the present invention, but which is not to be construed as a limitation thereof. All percentages reported herein, unless otherwise specified, are percent by weight. All temperatures are expressed in degrees Celsius.

EXAMPLE #1

Laboratory plating baths were evaluated on the Hydrodynamically controlled Hull Cell with a 1 minute plate time at up to 30 Amps. Plating strips were made of steel and were pretreated by soaking for 15 seconds in an alkaline bath, rinsing then immersing for 15 seconds in 10% sulfuric acid and rinsing again. The following bath was evaluated to which various levels of sodium isethionate were added.

Bath Composition:

5% Sulfuric Acid
20.0 g/l Sn (as stannous sulfate)
3 g/l JWL 5000 surfactant
0.1 g/l salicylic acid — Bath base
5 ppm 2.9 - Dimethyl - phenanthroline

| Run # | Additive and Level | Results of Plating Tests |
|---|---|---|
| 1 | No additive | Dark burn on high current density edge at 5 Amps. Burn is 12 mm wide at high current density edge at 10 Amps. |
| 2 | 10 g/1 Sodium isethionate (calculated as isethionic acid) | Even light gray satin deposit at 10 Amps - no burn. |
| 3 | 20 g/l Sodium isethionate (calculated as isethionic acid) | Even light gray satin deposit at 30 Amps - no burn. |
| 4 | 1 g/l Sodium Sulfate | Burn is 12 mm wide at high current density edge at 10 Amps. |
| 5 | 30 g/l Sodium Sulfate | Burn is 4 mm wide at high current density edge at 10 Amps. |

These results show that by adding sodium isethionate to this sulfate bath the current density range is increased significantly. A 15 Amp panel is indicative of current densities at 600 Amp/ft$^2$ and a 30 Amp range is equivalent to 1200 Amp/ft$^2$. They also show that sodium ions can have a positive effect on increasing the current density range but the sodium alkanol sulfonate has a much greater effect.

EXAMPLE #2

The same bath and procedure as in Example #1 was utilized but in this case the additive was sodium methyl sulfonate and current used was up to 10 Amps.

| Run # | Additive and Level | Results of Plating Tests |
|---|---|---|
| 1 | No additive | Dark burn on high current density edge at 5 Amps. |
| 2 | 10 g/l Sodium Methane Sulfonate (Calculated as Methane Sulfonic Acid) | At 10 Amps, even light gray, slightly reflective, satin deposit No burn. |
| 3 | 20 g/l Sodium Methane Sulfonate (Calculated as Methane Sulfonic Acid) | At 10 Amps, light gray satin deposit to the high current density end which was reflective. No burn. |

These results show that by adding sodium methane sulfonate to this sulfate bath the current density range is increased significantly.

EXAMPLE #3

The following experiments illustrate the inhibiting effect of the hydroxyl alkyl sulfonic acid salt in stannous sulfate/sulfuric acid solutions. The effect of iron to stabilize these stannous ion against oxidation is also illustrated when comparing Run #3 with others. Oxygen was bubbled through 150 ml of the following solutions for 64 hours at 120° F.

| RUN # | $SnSO_4$ $Sn^{+2}$ g/liter | $FeSO_4$ $Fe^{+2}$ g/liter | $H_2SO_4$ g/liter | $NaO_3SCH_2CH_2OH$ g/l | Decrease in $Sn^{2+}$ Conc g/l |
|---|---|---|---|---|---|
| 1 | 23 | 10 | 10 | 0 | 10.3 |
| 2 | 23 | 10 | 10 | 30 | 8.6 |
| 3 | 23 | 0 | 60 | 30 | 23 |
| 4 | 23 | 10 | 60 | 30 | 4.0 |
| 5 | 23 | 10 | 80 | 0 | 3.2 |
| 6 | 23 | 10 | 80 | 30 | 0.2 |

THEORY SECTION

While not wishing to be bound by theory, the results of the present invention are believed to be based upon the following:

The mixture of different ionic species forms a unique combination that can produce metallic coatings with required properties. It is well known that the overall ionic conductivity of the solution depends on the character of individual ionic species and their concentrations. The specific interactions between different ionic species and/or solvent molecules determine the overall conductivity and may affect electrodeposition processes. However, ionic conductivity is only one variable, which must be considered in formulating plating baths.

It is also well known that the structure of the electrical double layer can affect the rates of electrodeposition. It was proven experimentally, see for example, Lasia et al., *Journal of Electroanalytical Chemistry,* 266, 68–81 (1989); Fawcett et al., *Journal of Electroanalytical Chemistry,* 279, 243–256 (1990); Lasia et al., *Journal of Electroanalytical Chemistry,* 288, 153–165 (1990) and Balch et al., *Journal of Electroanalytical Chemistry,* 427, 137–146 (1997), that the rate constant of electroreduction of certain metal ions (like $Cu^+$, $Cd^{2+}$ or $Zn^{2+}$) depends on the solvating ability of the solvent and the size of the cation of the electrolyte. The effect was attributed to the electrostatic interactions in the inner layer of the electrical double layer.

According to the Frumkin model, the rate constant for the reduction process:

$$Met^{n+}+ne \rightarrow Met^0$$

is given by:

$$\ln k_f = \ln (k_0 Y_M) + \alpha_a nF\phi^d/RT - \alpha_a nF(E-E_s)/RT$$

where the symbols are:

$k_f$ apparent rate constant $k_0$ potential independent portion of the rate constant $Y_M$ activity coefficient of the species $Met^{n+}$ in the bulk solution $\alpha_a$ apparent transfer coefficient for reduction n number of electrons involved in electroreduction F Faraday constant $\phi^d$ potential drop across the diffuse layer R gas constant T temperature in K E potential $E_s$ standard potential of the electroreduction reaction It is also known that the size of the counter ion of supporting electrolyte affects the $\phi^d$ potential, and as a consequence, the rate constant of overall electroreduction process (Lasia et al., Fawcett et al., and Lasia et al., supra).

It is clear that the addition of one or more salts as taught herein modifies the double layer of metal/solution interface. The modification is caused by the alkali metal cation and/or alkanol-sulfonic acid anion and/or combination of both of them (maybe alkyl-, also). Therefore, the added salt of an alkyl and/or alkanol sulfonic acid should be considered as a plating additive, rather than as a simple modification of the supporting electrolyte. In the present invention, the cation and/or anion are not added only to preserve ionic conductivity of the electrolyte and/or solubility of deposited ion(s); instead they directly affect the electrodeposition process, by affecting the double layer structure and in consequence the mechanism of the electroreduction process.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of improving the plating performance of an aqueous sulfate based electroplating bath step of adding an effective amount of one or more salts of an unsubstituted alkyl and/or alkanol sulfonic acid to said bath to operate said bath at higher current densities, wherein the one or more salts are selected from the group consisting of alkali metal, alkaline earth metal, and ammonium or substituted ammonium salts.

2. The method of claim 1, wherein the one or more salts consist of a salt of 2-hydroxy ethyl sulfonic acid.

3. The method of claim 2, wherein the salt is sodium isethionate.

4. The method of claim 1, 2 or 3, wherein the electroplating bath is a tin or tin alloy plating bath.

5. The method of claim 4, wherein the tin alloy is tin-antimony.

6. The method of claim 4, wherein the tin alloy is tin-cadmium.

7. The method of claim 4, wherein the tin alloy is tin-copper.

8. The method of claim 4, wherein the tin alloy is tin-lead.

9. The method of claim 4, wherein the tin alloy is tin-nickel.

10. The method of claim 4, wherein the tin alloy is tin-niobium.

11. The method of claim 4, wherein the tin alloy is tin-titanium.

12. The method of claim 4, wherein the tin alloy is tin-zirconium.

13. The method of claim 4, wherein the tin alloy is tin-antimony-copper.

14. The method of claim 1, 2 or 3, wherein the electroplating bath is a nickel or nickel alloy plating bath.

15. The method of claims 1, 2 or 3, wherein the electroplating bath is a copper or copper alloy plating bath.

16. The method of claims 1, 2 or 3, wherein the electroplating bath is a chromium or chromium alloy plating bath.

17. The method of claims 1, 2 or 3, wherein the electroplating bath is a cadmium or cadmium alloy plating bath.

18. The method of claims 1, 2 or 3, wherein the electroplating bath is an iron or iron alloy plating bath.

19. The method of claims 1, 2 or 3, wherein the electroplating bath is a rhodium or rhodium alloy plating bath.

20. The method of claims 1, 2 or 3, wherein the electroplating bath is a ruthenium or ruthenium alloy plating bath.

21. The method of claims 1, 2 or 3, wherein the electroplating bath is an iron/zinc plating bath.

22. The method of claims 1, 2, or 3, wherein the electroplating bath is a tin/zinc plating bath.

23. The method of claim 1, wherein the improvement in the plating performance comprises at least an increase in the useful upper current density range of the plating bath.

24. An aqueous metal alloy sulfate electroplating bath comprising:

(a) a source of sulfate anions;

(b) one or more soluble metal salts, wherein the metal is selected from the group consisting of tin, nickel, copper, chromium, cadmium, iron, rhodium, ruthenium, zinc and mixtures thereof; and (c) one or more salts of an unsubstituted alkyl and/or alkanol sulfonic acid in an amount effective to operate said bath at higher current densities, wherein the one or more sulfonic acid salts are selected from the group consisting of alkali metal, alkaline earth metal, and ammonium or substituted ammonium salts.

25. The electroplating bath of claim 24, wherein the one or more sulfonic acid salts consist of a salt of 2-hydroxy ethyl sulfonic acid.

26. The electroplating bath of claim 25, wherein the salt is sodium isethionate.

27. An aqueous metal alloy sulfate electroplating bath comprising:

(a) a source of sulfate anions;

(b) one or more soluble metal salts, wherein the metal is selected from the group consisting of tin and mixtures of tin and a metal selected from the group consisting of nickel, copper, chromium, cadmium, iron, rhodium, ruthenium and zinc; and (c) one or more salts of an unsubstituted alkyl and/or alkanol sulfonic acid in an amount effective to improve the oxidative stability of the metal, wherein the one or more sulfonic acid salts are selected from the group consisting of alkali metal, alkaline earth metal, and ammonium or substituted ammonium salts.

28. The electroplating bath of claim 27, wherein the one or more sulfonic acid salts are selected from the group consisting of alkali metal, alkaline earth metal, ammonium and substituted ammonium salts.

29. The electroplating bath of claim 28, wherein the one or more sulfonic acid salts consist of a salt of 2-hydroxy ethyl sulfonic acid.

30. The electroplating bath of claim 29, wherein the salt is sodium isethionate.

31. The electroplating bath of claim 27, further comprising iron sulfate in an amount effective to further improve the oxidative stability of the metal.

* * * * *